US009436157B2

(12) United States Patent
Taguchi

(10) Patent No.: US 9,436,157 B2
(45) Date of Patent: Sep. 6, 2016

(54) IMAGE FORMING APPARATUS PROVIDED WITH PROCESS CARTRIDGE

(71) Applicant: Brother Kogyo Kabushiki Kaisha, Nagoya-shi, Aichi-ken (JP)

(72) Inventor: Kazuna Taguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/874,907

(22) Filed: Oct. 5, 2015

(65) Prior Publication Data

US 2016/0231695 A1 Aug. 11, 2016

(30) Foreign Application Priority Data

Feb. 6, 2015 (JP) ..... 2015-021726

(51) Int. Cl.
*G03G 21/18* (2006.01)
*G03G 15/00* (2006.01)

(52) U.S. Cl.
CPC ..... *G03G 21/1803* (2013.01); *G03G 15/50* (2013.01)

(58) Field of Classification Search
CPC ..... G03G 21/1821; G03G 21/181
See application file for complete search history.

(56) References Cited

U.S. PATENT DOCUMENTS

2010/0054799 A1* 3/2010 Nakamura ..... G03G 21/1832 399/114
2013/0209113 A1* 8/2013 Akimoto ..... G03G 15/70 399/21
2013/0279921 A1* 10/2013 Kanai ..... G03G 15/50 399/12

FOREIGN PATENT DOCUMENTS

JP 2007-248618 A 9/2007

* cited by examiner

*Primary Examiner* — Minh Phan
*Assistant Examiner* — Victor Verbitsky
(74) *Attorney, Agent, or Firm* — Banner & Witcoff, Ltd.

(57) ABSTRACT

An image forming apparatus includes a housing; a process cartridge; and a protective member. The process cartridge is detachably attached to the housing and includes a drum unit; and a developing unit. The drum unit includes a photosensitive member. The developing unit includes a developing roller; and a first wall. The developing roller defines a first axis extending in an axial direction and is configured to rotate about the first axix. The first wall has a first surface; and a second surface opposite thereto. The first surface extends in the axial direction and faces the developing roller. The protective member is detachably attached to the process cartridge and includes a spacer. The drum unit includes a second wall. The second wall has a third surface. The third surface extends in the axial direction and faces the second surface. The spacer is disposed between the second surface and the third surface.

16 Claims, 13 Drawing Sheets

IMAGE FORMING APPARATUS PROVIDED WITH PROCESS CARTRIDGE

CROSS REFERENCE TO RELATED APPLICATION

This application claims priority from Japanese Patent Application No. 2015-021726 filed Feb. 6, 2015. The entire content of this priority application is incorporated herein by reference.

TECHNICAL FIELD

The present disclosure relates to an image forming apparatus provided with a process cartridge attachable to and detachable from a housing of the apparatus.

BACKGROUND

An image forming apparatus is known in the art in which a process cartridge can be attached to and detached from a housing of the apparatus. Japanese Patent Application publication No. 2007-248618 discloses a process cartridge including a first frame supporting a photosensitive member, and a second frame movably supported to the first frame so that a developing roller is movable toward and away from the photosensitive member.

In terms of an image forming apparatus, the apparatus may be transported for shipping while the process cartridge is attached to the housing of the apparatus. The Japanese Patent Application Publication discloses a mechanism for separating the developing roller away from the photosensitive member so as to avoid plastic deformation of the developing roller during transportation.

SUMMARY

If shipping is made while the process cartridge is attached to the housing of the image forming apparatus, toner or developing agent may be leaked out of the process cartridge due to impact imparted thereon during transportation.

In view of the foregoing, it is an object of the disclosure to provide an image forming apparatus capable of restraining leakage of toner from the process cartridge.

In order to attain the above and other objects, the disclosure provides an image forming apparatus that includes a housing; a process cartridge; and a protective member. The process cartridge is detachably attached to the housing and includes a drum unit; and a developing unit. The drum unit includes a photosensitive member. The developing unit includes a developing roller; an accommodating portion; and a first wall. The accommodating portion is configured to accommodate developing agent. The developing roller defines a first axis extending in an axial direction and is configured to rotate about the first axis and supply the developing agent to the photosensitive member. The first wall has a first surface; and a second surface opposite thereto. The first surface extends in the axial direction and faces the developing roller. The protective member is detachably attached to the process cartridge and includes a spacer. The drum unit includes a second wall. The second wall has a third surface. The third surface extends in the axial direction and faces the second surface. The spacer is disposed between the second surface and the third surface.

BRIEF DESCRIPTION OF THE DRAWINGS

The particular features and advantages of the embodiment as well as other objects will become apparent from the following description taken in connection with the accompanying drawings, in which.

DETAILED DESCRIPTION

Next, an image forming apparatus according to one embodiment will be described with reference to drawings. In the following description, a laser printer 1 will be described as an example of the image forming apparatus. Throughout the specification, the terms "upward", "downward", "upper", "lower", "above", "below", "beneath", "right", "left", "front", "rear" and the like will be used assuming that the laser printer 1 is disposed in an orientation in which it is intended to be used. More specifically, in FIG. 1, a right side and a left side are a front side and a rear side of the printer, respectively. Further, in FIG. 1, a far side and a near side are a right side and a left side of the printer, respectively.

Figure 1:
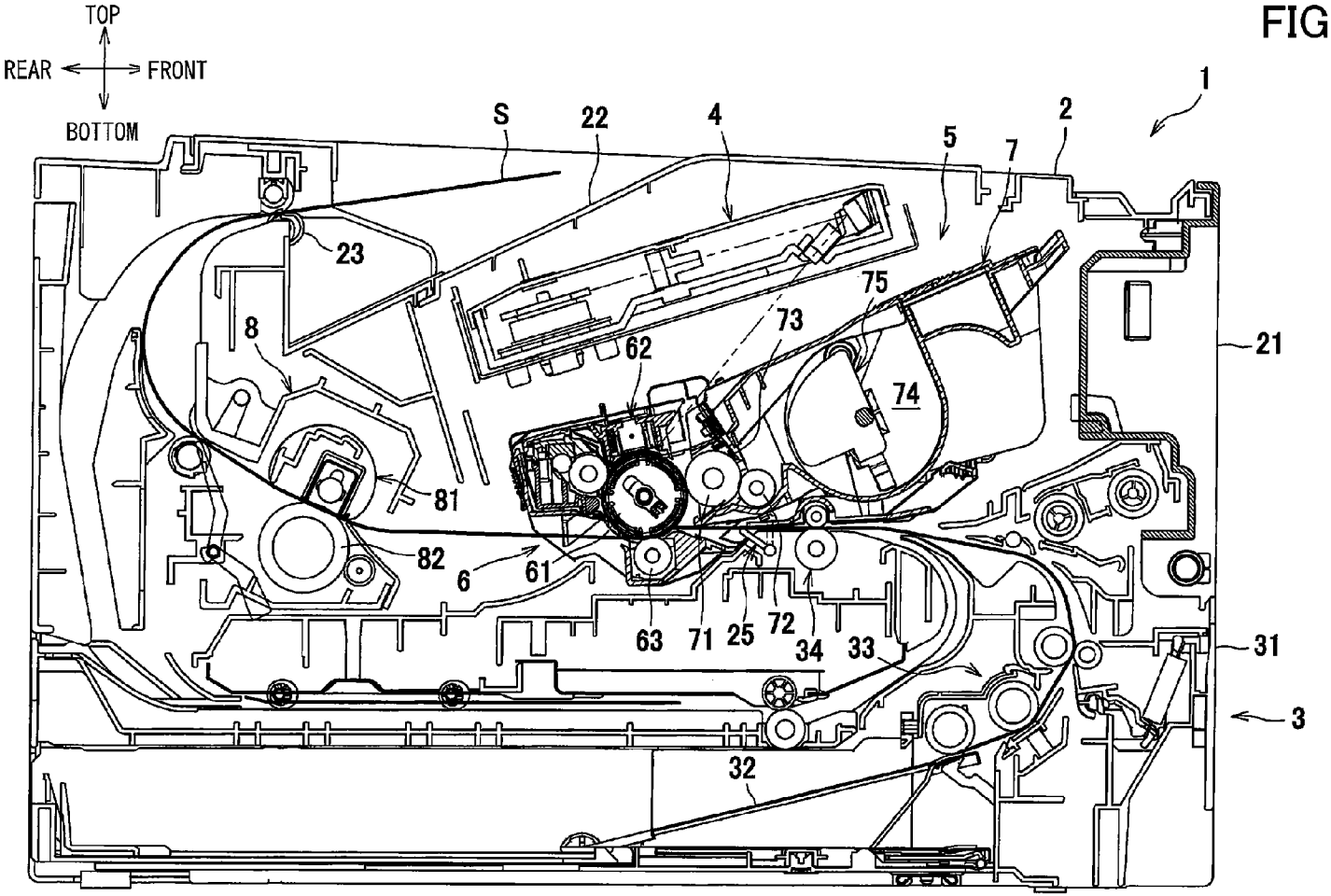
FIG. 1 is a schematic cross-sectional view of a laser printer as an example of an image forming apparatus according to one embodiment.

Further, in FIG. 1, a top side and a bottom side are a top side and a bottom side of the printer, respectively.

As illustrated in FIG. 1, the laser printer 1 includes a housing 2. The laser printer 1 further includes, within the housing 2, a sheet supply unit 3, an exposure unit 4, a process cartridge 5, and the fixing unit 8.

The housing 2 is provided with a front cover 21. The front cover 21 covers an opening formed in the housing 2 at its closed position and exposes the opening at its open position. The sheet supply unit 3 is disposed in the housing at a bottom portion thereof. The sheet supply unit 3 includes a sheet supply tray 31 for accommodating sheets S, a lifter plate 32 for lifting up front edges of the sheets S, a sheet supplying mechanism 33, and a pair of registration rollers 37. The sheets S accommodated in the sheet supply tray 31 are directed upward by the lifter plate 32, and are supplied toward the process cartridge 5 by the sheet supplying mechanism 33. Each sheet S is conveyed to a position between a photosensitive drum 61 and a transfer roller 63 after passing through registration rollers 34.

The exposure unit 4 is disposed in the housing 2 at a top portion thereof. The exposure unit 4 includes a laser emission unit, a polygon mirror, lenses, and reflection mirrors those not shown. In the exposure unit 4, a laser beam (indicated by a two dotted chain line in FIG. 1) based on image data is emitted from the laser emission unit, and the laser beam scans a surface of the photosensitive drum 61 at a high speed, so that the surface of the photosensitive drum 61 is exposed to light.

The process cartridge 5 is disposed below the exposure unit 4. The process cartridge 5 is detachable from and attachable to the housing 2 through the opening formed in the housing 2. The process cartridge 5 includes a drum unit 6 and a developing unit 7.

The developing unit 7 includes a developing roller 71, a supply roller 72, a layer thickness regulation blade 73, a toner-accommodating section 74 for accommodating toner as an example of developing agent therein, and an agitator 75. The drum unit 6 is configured to allow the developing unit 7 to be attached to an detached from the drum unit 6. The drum unit 6 includes the photosensitive drum 61 as an example of a photosensitive member, a charger 62, and the transfer roller 63.

In the process cartridge 5, the surface of the photosensitive drum 61 is exposed to light by high speed scan of the laser beam emitted from the exposure unit 4 after the charger 62 applies a uniform charge to the surface of the photosensitive drum 61. As a result, an electrostatic latent image based on the image data is formed on the photosensitive drum 61. At this time, the toner accommodated in the toner-accommodating section 74 is agitated by the agitator 75, and is supplied to the developing roller 71 through the supply roller 72. The toner supplied to the developing roller 71 is carried on the developing roller 71 as a thin toner layer having a uniform thickness by the layer thickness regulation blade 73 in accordance with rotation of the developing roller 71.

The toner carried on the developing roller 71 is supplied to the electrostatic latent image formed on the photosensitive drum 61. As a result, a visible toner image corresponding to the electrostatic latent image is formed on the photosensitive drum 61. Subsequently, the toner image formed on the photosensitive drum 61 is transferred onto the sheet S while the sheet S is conveyed between the photosensitive drum 61 and the transfer roller 63.

The fixing unit 8 is disposed rearward of the process cartridge 5. The fixing unit 8 includes a heat unit 81 and a pressure roller 82. The heat unit 81 includes a halogen heater, a fixing belt, and a nip plate those not shown. The pressure roller 82 is adapted to nip the fixing belt between the nip plate and the pressure roller 82. The toner image transferred onto the sheet S is thermally fixed thereon while the sheet S passes through a position between the heat unit 81 and the pressure roller 82. The sheet S onto which the toner image has been thermally fixed is discharged on a discharge tray 22 by conveying rollers 23.

Figure 2:
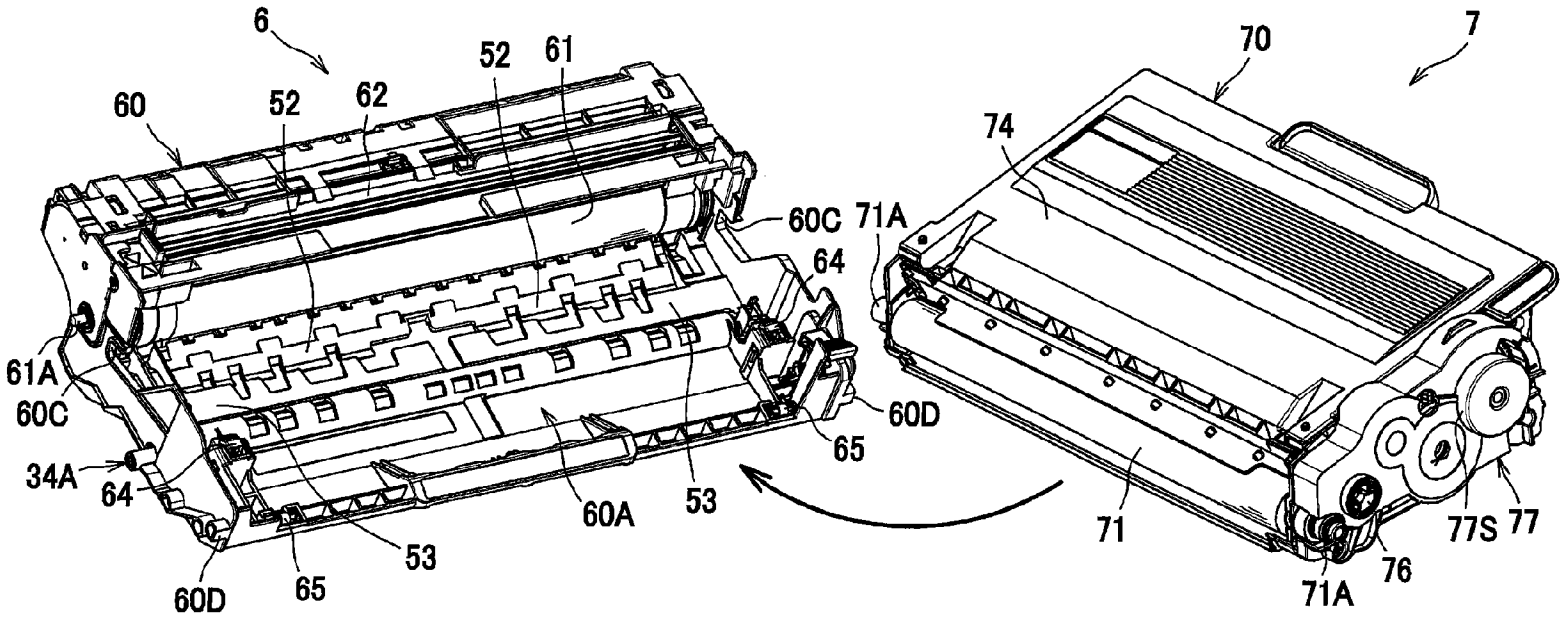
FIG. 2 is a perspective view of a drum unit and a developing unit in the laser printer according to the embodiment.

As shown in FIG. 2, in addition to the developing roller 71 and toner accommodating portion 74, the developing unit 7 includes a development frame 70, a coupling 76 as an example of the drive receiving unit, and a cover 77.

Figure 3:
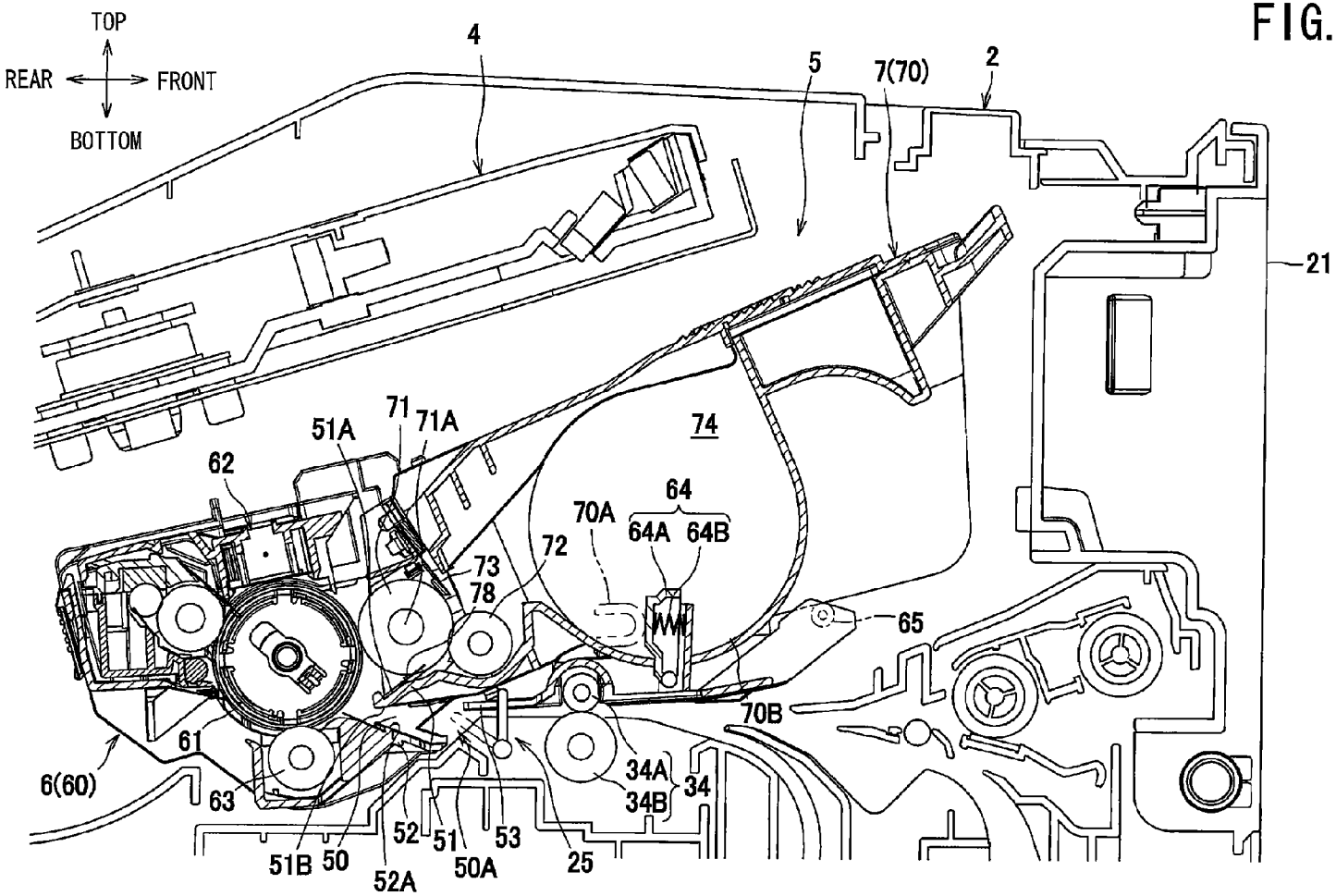
FIG. 3 is an enlarged cross-sectional view of the laser printer according to the embodiment.

As shown in FIG. 3, the development frame 70 rotatably supports the developing roller 71, the supply roller 72, and the like and forms the toner accommodating portion 74 therein. The development frame 70 has a first wall 51. The first wall 51 constitutes part of a bottom wall 70B of the developing unit 7, and specifically the rear portion of the bottom wall 70B. In a cross-sectional view, the front portion of the bottom wall 70B curves in a general arc shape whose convex side faces downward to from the bottom wall of the toner accommodating portion 74. At the approximate front-rear center of the developing unit 7, the bottom wall 70B extends downward, and then the rear portion of the bottom wall 70B extends rearward in a shape that conforms to the outer circumferences of the supply roller 72 and the developing roller 71. The first wall 51 extends in the left-right direction (the axial direction of the developing roller 71). The first wall 51 includes a top surface 51A that confronts and faces the developing roller 71, and a bottom surface 51B on the opposite side from the top surface 51A. The top surface 51A is an example of the first surface, while the bottom surface 51B is an example of the second surface. Toner supplied from the toner accommodating portion 74 is present in (enters) the space between the first wall 51 and the developing roller 71.

A lower film 78 is disposed between the developing roller 71 and the first wall 51. One end of the lower film 78 is fixed to the first wall 51, while the other end is positioned so as to contact the developing roller 71 in order to prevent toner from leaking through the space between the developing roller 71 and the first wall 51.

Figure 6A:
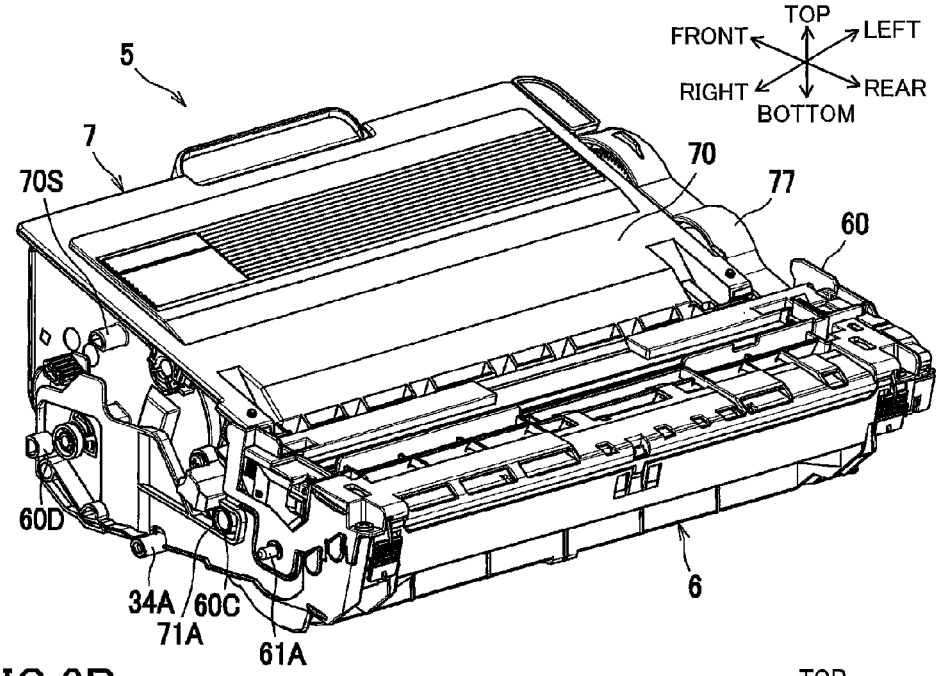
FIG. 6A is a perspective view of the process cartridge as viewed from a right side.

Contact parts 70A are provided on the outer surfaces of the left and right side walls constituting the development frame 70 and protrude outward in corresponding left and right directions therefrom. As shown in FIG. 6A, a protruding part 70S is disposed on the outer surface of the right wall constituting the development frame 70 and protrudes rightward therefrom.

As shown in FIG. 2, the coupling 76 is rotatably supported on the left wall of the development frame 70. A drive force from the main casing 2 is inputted into the coupling 76. The coupling 76 transmits the drive force to the developing roller 71, the supply roller 72, and the agitator 75 through a drive transmission mechanism (not shown), such as a plurality of gears, provided on the left surface of the development frame 70 for driving these components to rotate.

The cover 77 is mounted on the left wall of the development frame 70 and covers the coupling 76 and the drive transmission mechanism described above. A protruding part 77S is provided on the outer surface of the cover 77 and protrudes leftward therefrom.

In addition to the photosensitive drum 61, the charger 62, and the transfer roller 63 described above, the drum unit 6 includes a drum frame 60, pressing members 64, positioning rollers 65, and a follow roller 34A as an example of the second roller.

The drum frame 60 functions to rotatably support the photosensitive drum 61, the follow roller 34A, and the like, as well as to form a mounting section 60A in which the developing unit 7 is detachably mounted. An engaging recess 60C is formed in each of the left and right side walls constituting the drum frame 60. The engaging recesses 60C are open on the front side. Rotational shafts 71A of the developing roller 71 engage in the corresponding engaging recesses 60C when the developing unit 7 is mounted in the drum unit 6. A boss 60D is provided on each of the left and right side walls of the drum frame 60. The bosses 60D protrude outward in respective left and right directions.

As shown in FIG. 3, the drum frame 60 has a second wall 52 and a third wall 53 configuring the bottom wall of the drum unit 6. The second wall 52 is positioned beneath the first wall 51 when the developing unit 7 is mounted in the drum unit 6 and is separated a prescribed distance from the first wall 51. The second wall 52 has a top surface 52A that confronts and faces the bottom surface 51B of the first wall 51. The top surface 52A is an example of the third surface. The third wall 53 is positioned entirely forward of the second wall 52 and oppose nearly the entire bottom wall 70B of the developing unit 7, excluding the first wall 51. The third wall 53 is also arranged higher than the rear edge of the second wall 52 and extends in the general front-rear direction.

The first wall 51 and second wall 52 form the walls of a path 50 that functions to guide sheets S from outside the process cartridge 5 toward the photosensitive drum 61, and more specifically toward the point between the photosensitive drum 61 and the transfer roller 63. Further, the rear edge of the second wall 52 and the front edge of the third wall 53 from an opening 50A that serves as the entrance to the path 50.

When the developing unit 7 is mounted in the drum unit 6, the pressing members 64 press the contact parts 70A of the developing unit 7 rearward in order to urge the developing roller 71 toward the photosensitive drum 61. Each of the pressing members 64 primarily includes a pressing arm 64A, and a coil spring 64B. The pressing arms 64A are supported on the drum frame 60 so as to be capable of pivoting forward and rearward. The coil springs 64B are disposed between the corresponding pressing arms 64A and the drum frame 60.

When the developing unit 7 is mounted in the drum unit 6, the contact parts 70A contact the corresponding pressing arms 64A and force the pressing arms 64A to pivot forward. When pressing arms 64A pivot forward, the coil springs 64B are compressed. Thus, the restoring force of the coil springs 64B causes the pressing arms 64A to press the contact parts 70A rearward. Consequently, the entire developing unit 7 is urged rearward in order to press the developing roller 71 against the photosensitive drum 61. In the embodiment, the developing roller 71 is configured to supply toner to the photosensitive drum 61 while contacting the same.

The positioning rollers 65 are disposed on the front edge of the drum frame 60, with one on each of the left and right sides. The positioning rollers 65 are rotatably supported on the drum frame 60 about shafts aligned in the left-right direction. When the developing unit 7 is mounted in the drum unit 6, the developing unit 7 contacts the tops of the positioning rollers 65, thereby enabling the developing unit 7 to be positioned relative to the drum unit 6. Further, the positioning rollers 65 rotate when the developing unit 7 is mounted in and removed from the drum unit 6, facilitating the mounting and removing operations.

The follow roller 34A and a drive roller 34B provided in the main casing 2 as an example of the first roller constitute the registration rollers 34. The follow roller 34A is rotatably supported in the drum frame 60. When the process cartridge 5 is mounted in the main casing 2, the follow roller 34A is positioned above the drive roller 34B. The registration rollers 34 are arranged on the upstream side of the photosensitive drum 61 in the conveying direction of the sheets S, i.e., forward of the photosensitive drum 61. When the drive roller 34B is driven to rotate, the follow roller 34A follows the rotation, and together the registration rollers 34 convey sheets S to a position between the photosensitive drum 61 and the transfer roller 63.

The follow roller 34A is supported in the drum frame 60 with play in the vertical direction. That is, the follow roller 34A can move vertically between an uppermost position (see FIG. 13A) as an example of the first position, and a lowermost position (see FIG. 13B) as an example of the second position. When the process cartridge 5 is mounted in the main casing 2, the follow roller 34A contacts the drive roller 34B with pressure due to springs (not shown) provided in the main casing 2 that urge the follow roller 34A toward the drive roller 34B.

Figure 4:
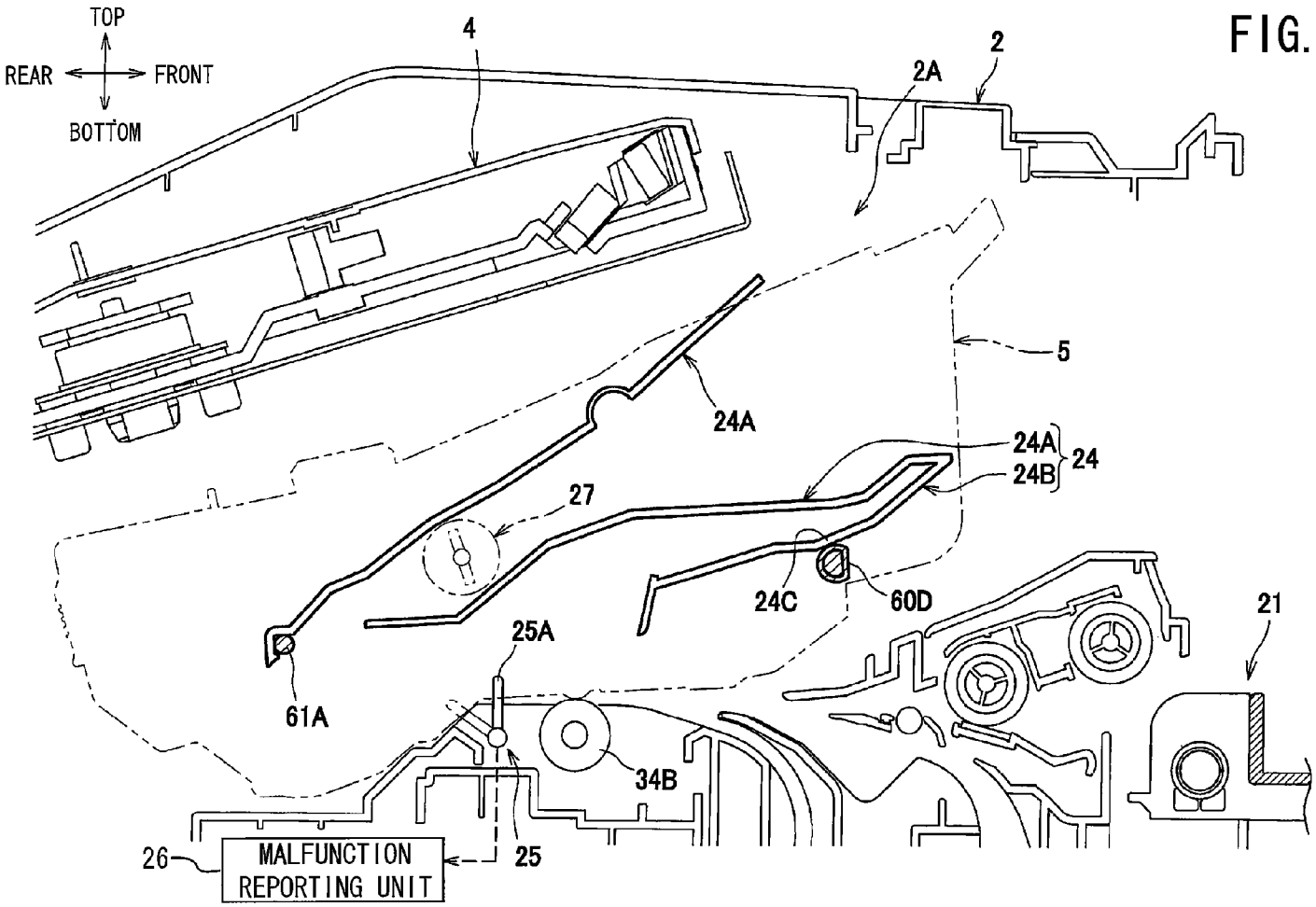
FIG. 4 is an enlarged cross-sectional view of a housing of the laser printer according to the embodiment.

As shown in FIG. 4, the main casing 2 includes a mounting section 2A, a pair of left and right guides 24 (only one is shown in FIG. 4), a sensor 25 as an example of the sensing member, a malfunction reporting unit 26, and a drive input member 27.

The mounting section 2A is the region of the main casing 2 in which the process cartridge 5 is mounted. The mounting section 2A is revealed when the front cover 21 is opened.

The left and right guides 24 are structured to guide the process cartridge 5 to a mounted position indicated by a double chain line in FIG. 4. Each guide 24 primarily includes a pair of drum guides 24A for guiding a drum shaft 61A of the photosensitive drum 61 and a boss guide 24B for guiding the corresponding boss 60D on the drum frame 60 when the process cartridge 5 is mounted in the main casing 2. The boss guide 24B has a boss contact part 24C that contacts the boss 60D when the process cartridge 5 is mounted in the main casing 2.

The sensor 25 detects the presence of a sheet S being conveyed in the main casing 2. The sensor 25 is disposed along the conveying path of the sheet S between the registration rollers 34 and the photosensitive drum 61, i.e., to the rear of the registration rollers 34. The sensor 25 primarily includes an actuator 25A that pivots when contacted by a sheet S, and a photosensor (not shown) that detects when the actuator 25A pivots. The actuator 25A is supported so as to be capable of pivoting between a non-detection position depicted by a solid line in FIG. 4, and a detection position depicted by a chain line. The actuator 25A pivots from the non-detection position to the detection position when contacted by a sheet S, and is returned from the detection position to the non-detection position by the urging force of a spring (not shown) after the sheet S passes over the actuator 25A.

The malfunction reporting unit 26 functions to report malfunction to the user. In the embodiment, the malfunction reporting unit 26 notifies the user that a paper jam has occurred when a sheet S becomes jammed in the laser printer 1. More specifically, the malfunction reporting unit 26 determines that a sheet S has become jammed in the laser printer 1 and notifies the user of this paper jam when the sensor 25 continuously detects the presence of a sheet S for more than a predetermined time, i.e., when the actuator 25A is in the detection position for at least the prescribed time. Here, the malfunction reporting unit 26 notifies the user by displaying an error message on a liquid crystal display provided on the main casing 2, by playing a warning sound from a speaker, and the like.

Figure 5A:
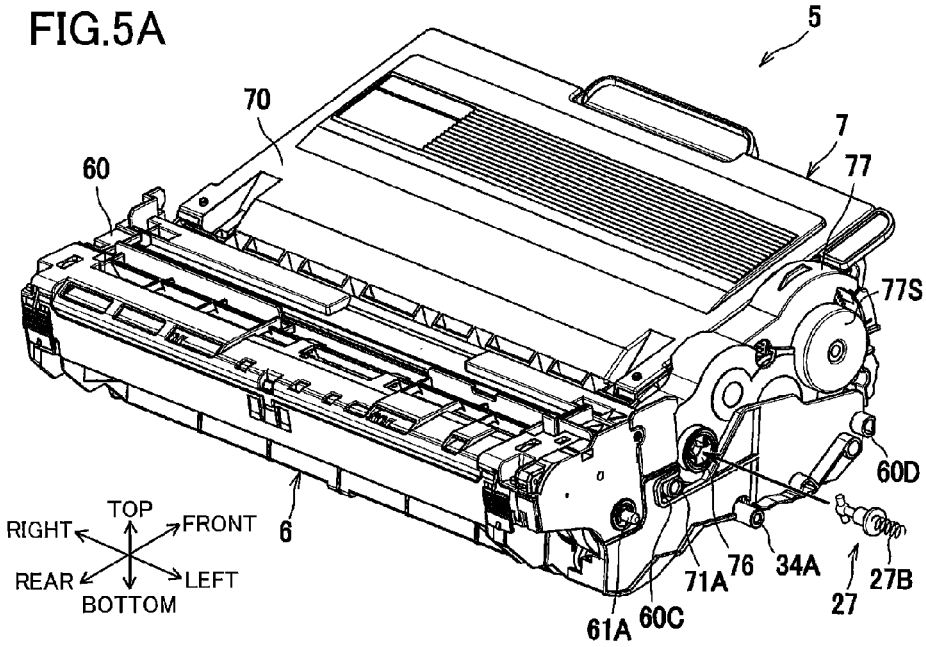
FIG. 5A is a perspective view of the process cartridge as viewed from a left side.

As shown in FIG. 5A, the drive input member 27 functions to input a drive force from a motor (not shown) provided in the main casing 2 to the coupling 76 of the process cartridge 5. The drive input member 27 is provided in the left wall of the main casing 2 and is configured to advance and retract in the left-right direction according to a mechanism known in the art. Specifically, the drive input member 27 advances inward (rightward) in association with an operation to close the front cover 21, and retracts outward (leftward) in association with an operation to open the front cover 21. When advanced inward, the drive input member 27 engages with the coupling 76 of the process cartridge 5 mounted in the main casing 2 and can input a drive force into the coupling 76. When retracted outward, the drive input member 27 disengages from the coupling 76.

In the embodiment, the drive input member 27 is elastically advanced and retracted in the left-right direction by the action of a spring 27B. With this configuration, even though a force relative to the outward (leftward) direction acts on the drive input member 27 when the drive input member 27 advances inward (rightward), the spring 27B compresses to reduce the force applied to the drive input member 27.

Figure 5B:
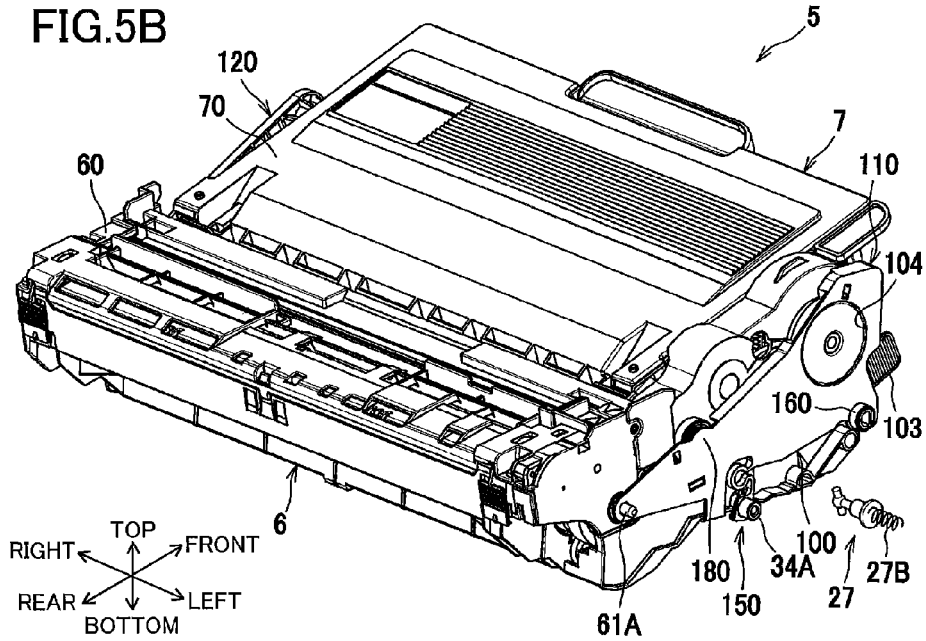
FIG. 5B is a perspective view of the process cartridge as viewed from a left side in which a protection assembly is attached to the cartridge.
Figure 6B:
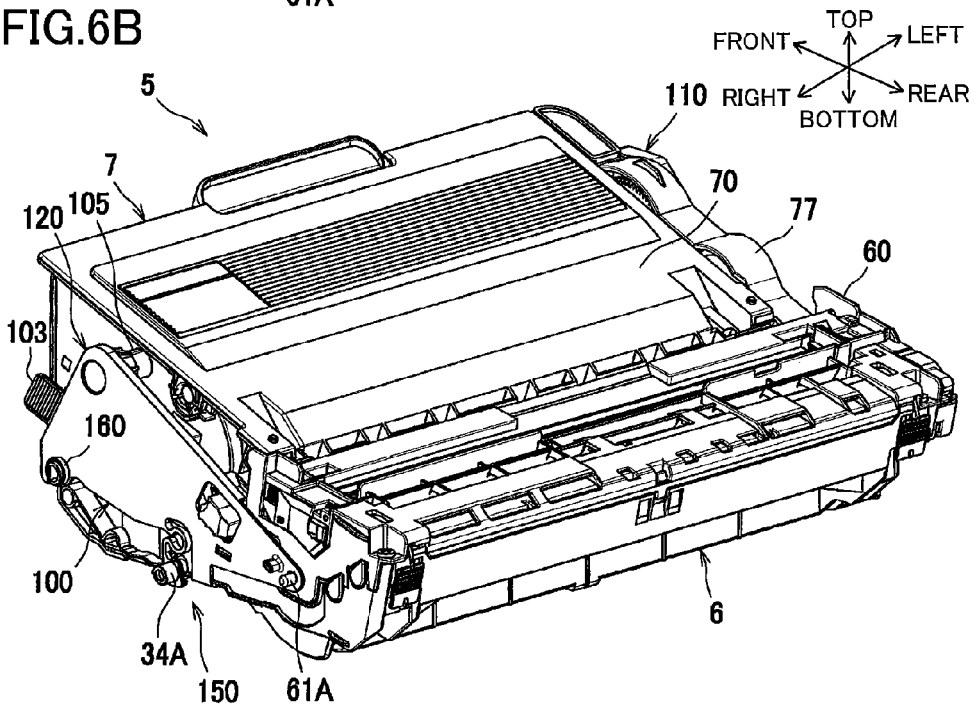
FIG. 6B is a perspective view of the process cartridge as viewed from a right side in which the protection assembly is attached to the cartridge.

In the embodiment, the laser printer 1 is shipped from the factory with the process cartridge 5 mounted in the main casing 2. At this time, a detachable protection assembly 100 is attached to the process cartridge 5 as shown in FIGS. 5B and 6B. The protection assembly 100 is an example of the protective member.

Figure 7A:
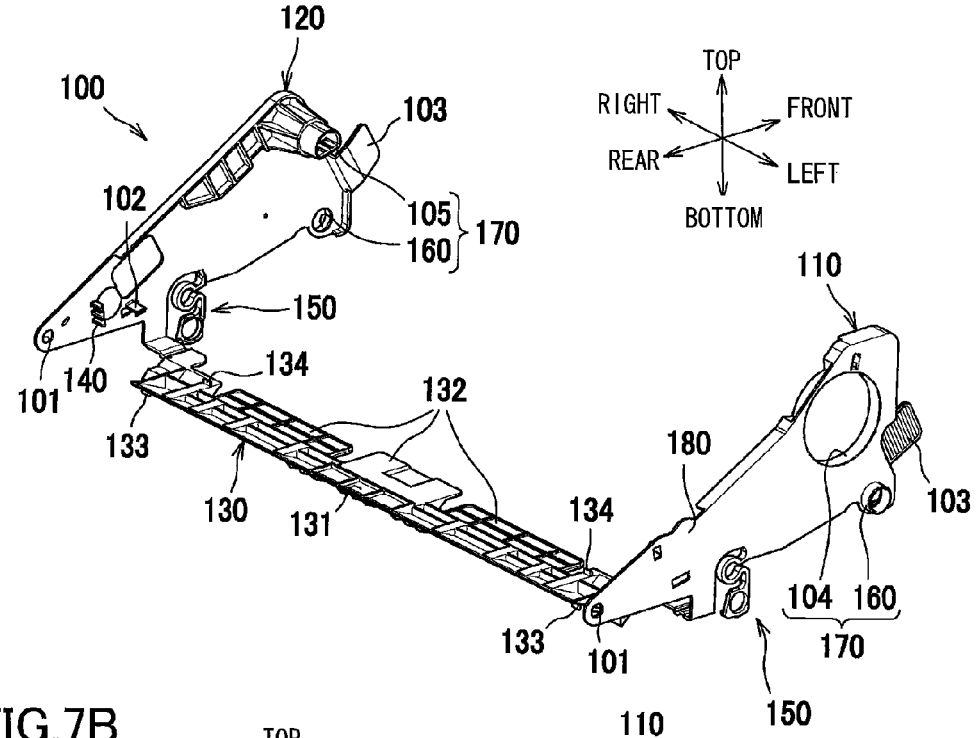
FIG. 7A is a perspective view of the protection assembly as viewed from a left side.
Figure 7B:
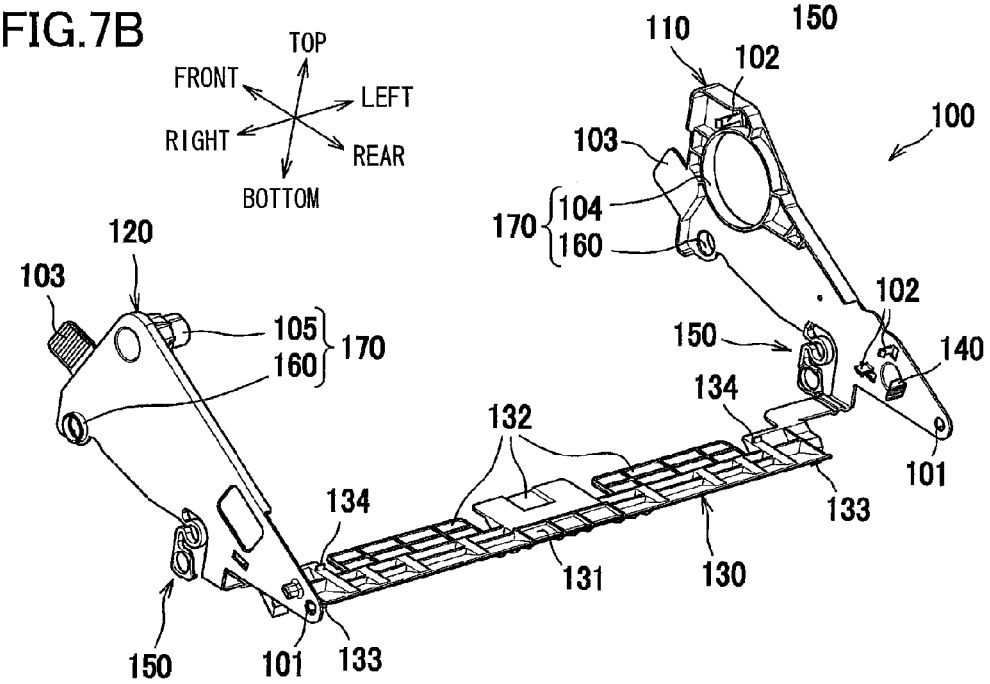
FIG. 7B is a perspective view of the protection assembly as viewed from a right side.

As shown in FIGS. 7A and 7B, the protection assembly 100 is a single, integrated member. The protection assembly 100 may be formed of polypropylene resin, for example. The protection assembly 100 has a left portion 110 that attaches to the left side of the process cartridge 5, a right portion 120 that attaches to the right side of the process cartridge 5, and a spacer 130 that attaches to the bottom of the process cartridge 5.

Each of the left and right portions 110 and 120 has a drum engaging hole 101, an anchoring pawl 102, and a grip 103. A first-protrusion engaging part 104 is formed in the left portion 110, while a second-protrusion engaging part 105 is provided on the right portion 120.

The drum engaging holes 101 are holes that penetrate the left and right portions 110 and 120 for engaging with the drum shaft 61A of the photosensitive drum 61. The drum engaging holes 101 are formed in the rear ends of the left and right portions 110 and 120.

The anchoring pawls 102 are anchored on the drum frame 60 and development frame 70 when the protection assembly 100 is attached to the process cartridge 5. By anchoring the anchoring pawls 102 on the drum frame 60 and development frame 70, the protection assembly 100 does not easily come off the process cartridge 5 due to vibrations and the like during transport.

The grips 103 are the parts of the left and right portions 110 and 120 that are operated when the protection assembly 100 is attached to and detached from the process cartridge 5. The grips 103 are disposed on the front edges of the left and right portions 110 and 120.

The first-protrusion engaging part 104 is provided in the top front corner of the left portion 110. The first-protrusion engaging part 104 engages with the protruding part 77S formed on the left wall of the developing unit 7 when the protruding part 77S is inserted through the first-protrusion engaging part 104.

The second-protrusion engaging part 105 is provided on the top front corner of the right portion 120. The second-protrusion engaging part 105 engages with the protruding part 70S formed on the right side of the developing unit 7 when the protruding part 70S is inserted in the second-protrusion engaging part 105.

In addition to the spacer 130, the features of the protection assembly 100 related to the present disclosure are first separating parts 140, second separating parts 150, boss engaging parts 160, retaining parts 170, and a covering part 180. In the following description, the protection assembly 100 will be said to be in an attached state when mounted on the process cartridge 5, and in a detached state when not mounted on the process cartridge 5.

The spacer 130 extends in the left-right direction and bridges the bottom edges of the left and right portions 110 and 120 near the rear ends thereof. The spacer 130 primarily includes a spacer body 131, exposed parts 132, and retaining parts 133 and 134.

Figure 8:
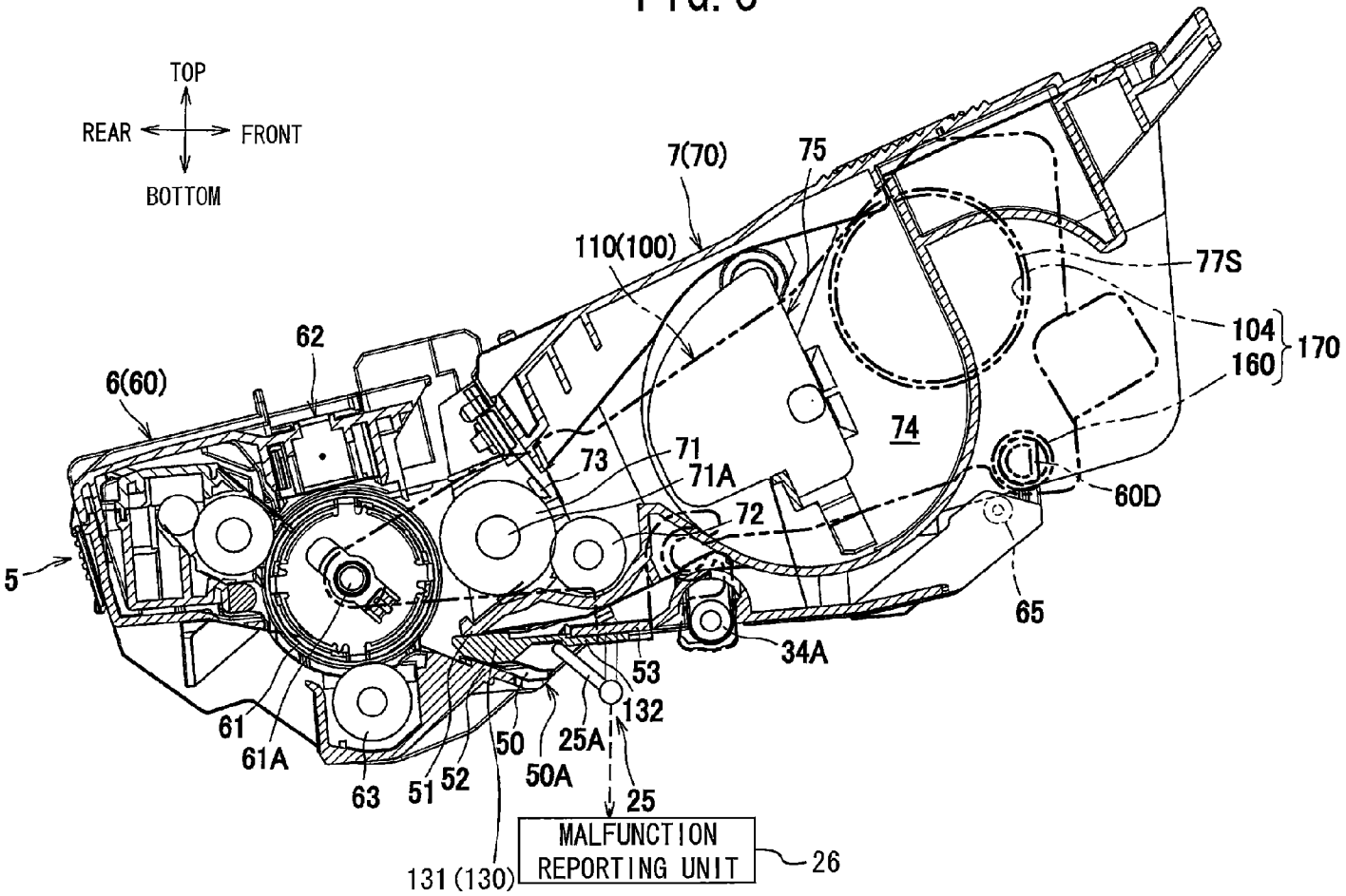
FIG. 8 is a cross-sectional view of the process cartridge to which the protection assembly is attached.
Figure 9:
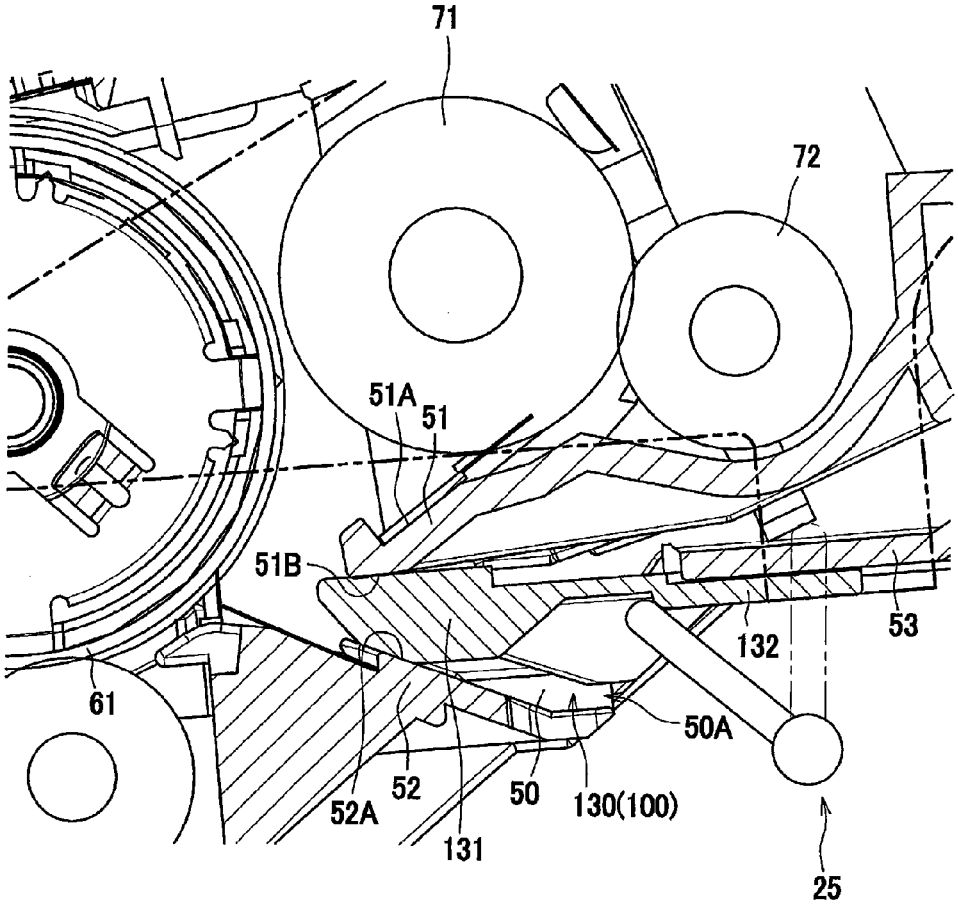
FIG. 9 is a partial enlarged cross-sectional view of the process cartridge to which the protection assembly is attached.

As shown in FIG. 8, the spacer body 131 has a general wedge shape that grows narrower toward the rear edge (the downstream side in the direction of insertion) when viewed along the left-right direction. The spacer 130 is mounted on the process cartridge 5 by inserting the wedge-shaped spacer body rearward through the opening 50A formed in the path 50 and between the first wall 61 and the second wall 52. As shown in FIG. 9, the spacer body 131 is disposed between the bottom surface 51B of the first wall 51 and the top surface 52A of the second wall 52 when the protection assembly 100 is in the attached state. More specifically, the spacer body 131 is in contact with both the bottom surface 51B of the first wall 51 and the top surface 52A of the second wall 52 when the protection assembly 100 is in the attached state. Thus, the first wall 51 and the second wall 52 hold the spacer 130 with the spacer body 131 interposed therebetween.

Figure 10A:
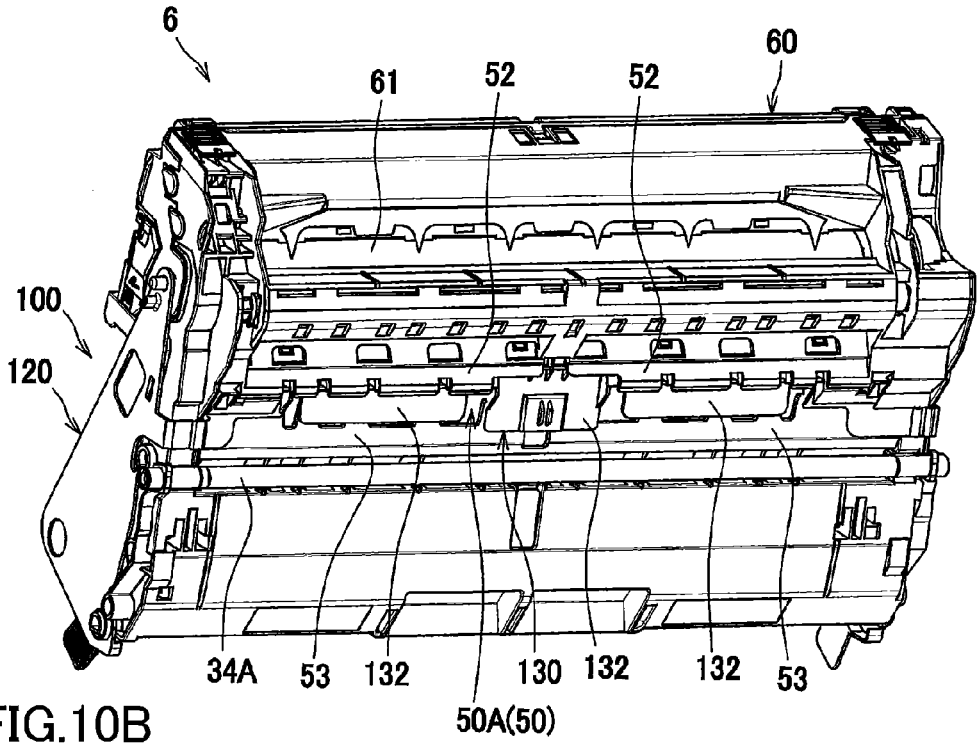
FIG. 10A is a perspective view of the drum unit to which the protection assembly is attached as viewed from below.
Figure 10B:
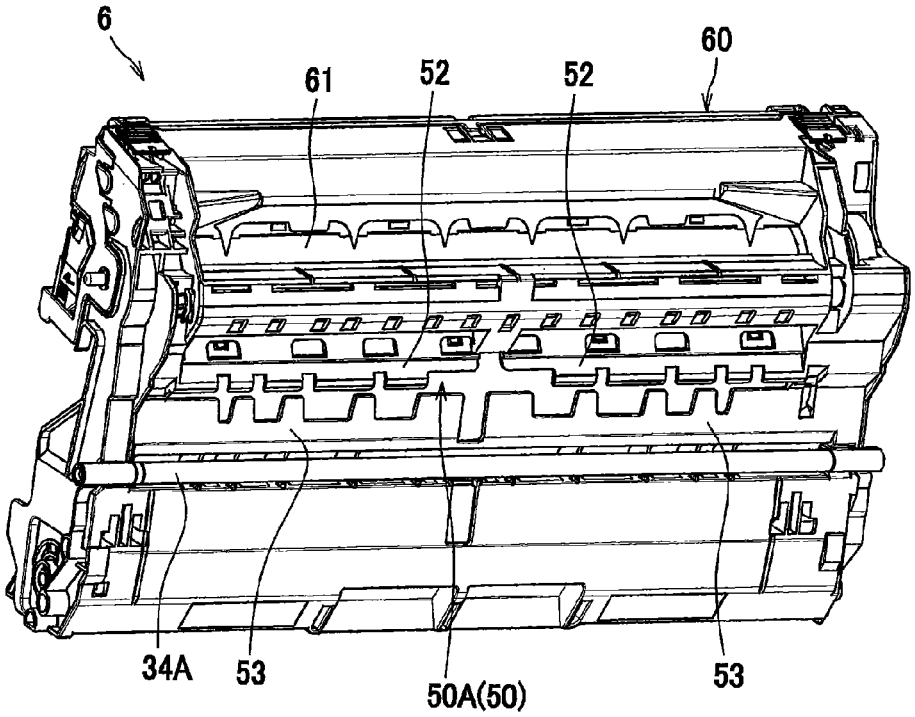
FIG. 10B is a perspective view of the drum unit as viewed from below.

As shown in FIG. 7, the exposed parts 132 extend forward from the front edge of the spacer body 131. Three exposed parts 132 juxtaposed in the left-right direction are provided in the embodiment. As shown in FIG. 10A, the exposed parts 132 pass through the opening 50A and protrude from the path 50 (from between the first wall 51 and the second wall 52) so as to be exposed on the bottom of the drum unit 6 when the protection assembly 100 is in the attached state. The exposed parts 132 can be made more visible by forming the protection assembly 100 and the drum frame 60 (process cartridge 5) in different colors. FIG. 10B is a perspective view from the bottom of drum unit 6 when the protection assembly 100 is in the detached state for comparison purposes with FIG. 10A.

Figure 11:
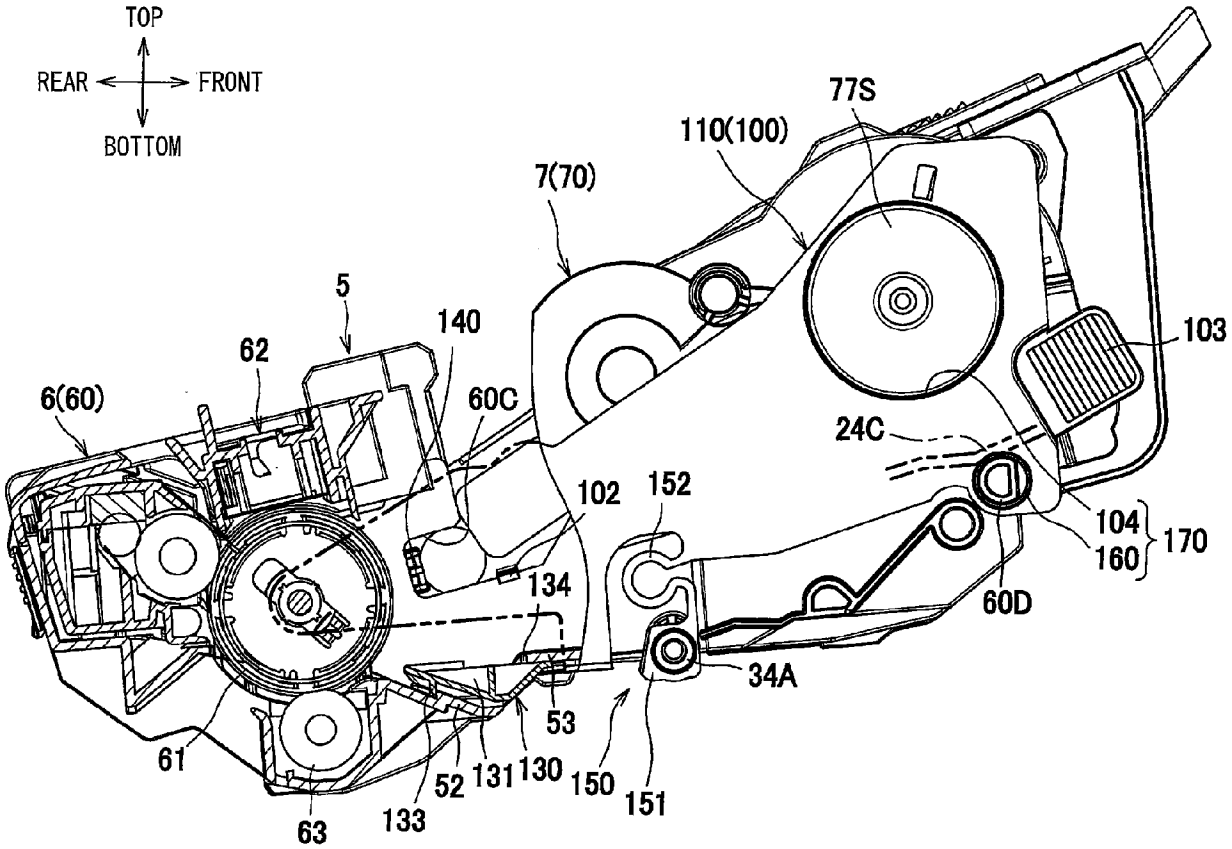
FIG. 11 is a left side view partially cross-sectioned illustrating the process cartridge to which the protection assembly is attached.

As shown in FIGS. 7A and 7B, the retaining parts 133 and 134 protrude from the spacer body 131 in a general vertical direction (a direction that intersects the insertion direction of the spacer 130). One each of the retaining parts 133 and 134 is provided on both the left and right sides of the spacer body 131. The retaining parts 133 protrude downward from the spacer body 131, while the retaining parts 134 protrude upward from the spacer body 131 at positions both inward in the left-right direction and rearward of the respective retaining parts 133. As shown in FIG. 11, the retaining parts 133 engage in stepped parts (not provided with reference numerals in FIG. 11) formed in the second wall 52 of the drum unit 6, and the retaining parts 134 engage in the rear end of the third wall 53 constituting the drum unit 6 when the protection assembly 100 is in the attached state.

Figure 12A:
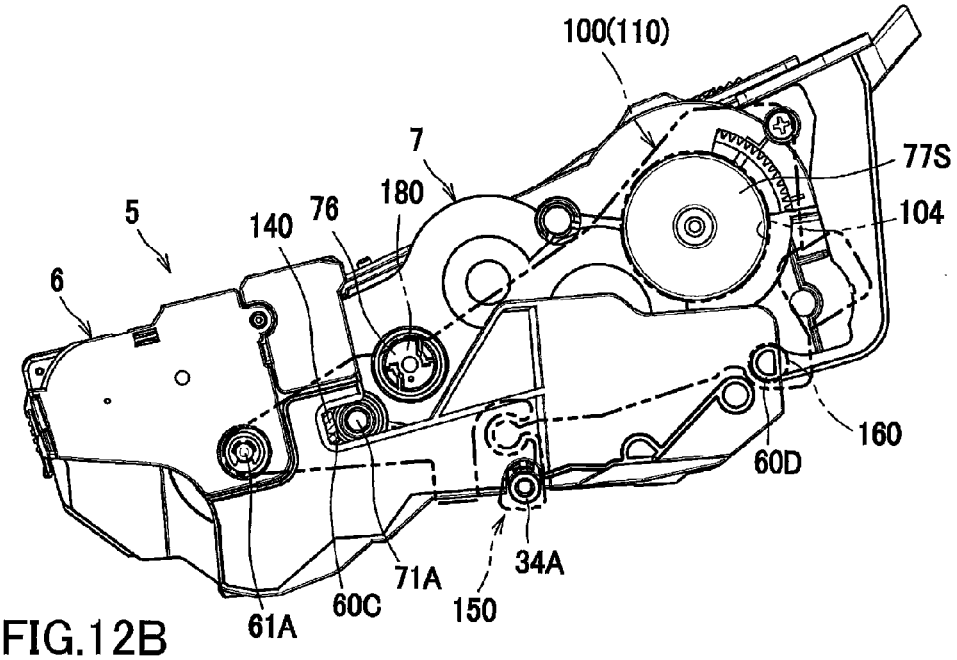
FIG. 12A is a left side view of the process cartridge to which the protection assembly is attached.
Figure 12B:
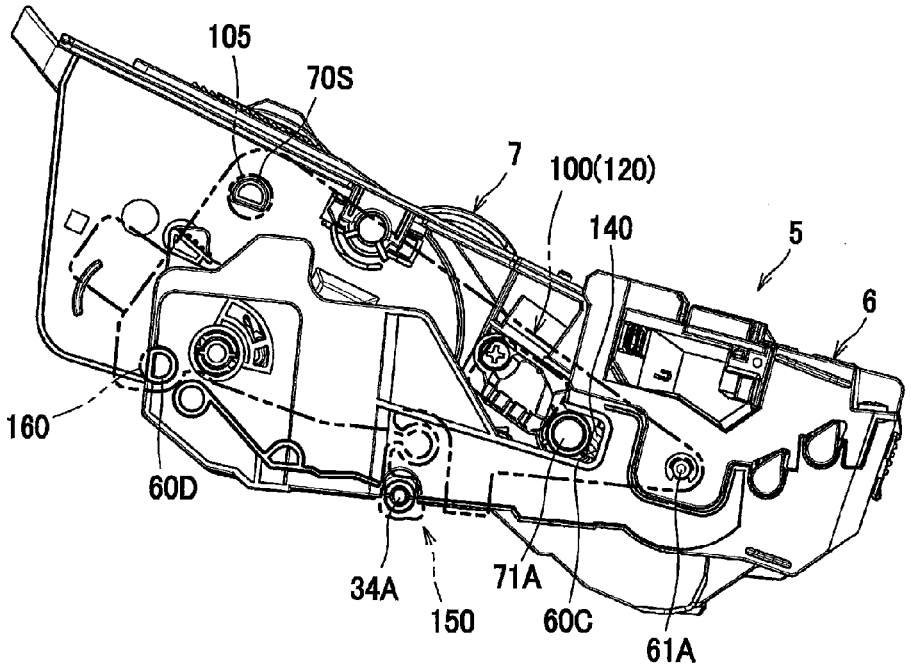
FIG. 12B is a right side view of the process cartridge to which the protection assembly is attached.

The first separating parts 140 shown in FIG. 7 function to maintain the photosensitive drum 61 and the developing roller 71 in a separated state. The first separating parts 140 are formed as protrusions that protrude inward in the left-right direction. As shown in FIGS. 12A and 12B, the first separating parts 140 are engaged between the rotational shafts 71A of the developing roller 71 and the rear parts of the engaging recesses 60C, the developing roller 71 can be separated from the photosensitive drum 61.

Figure 13A:
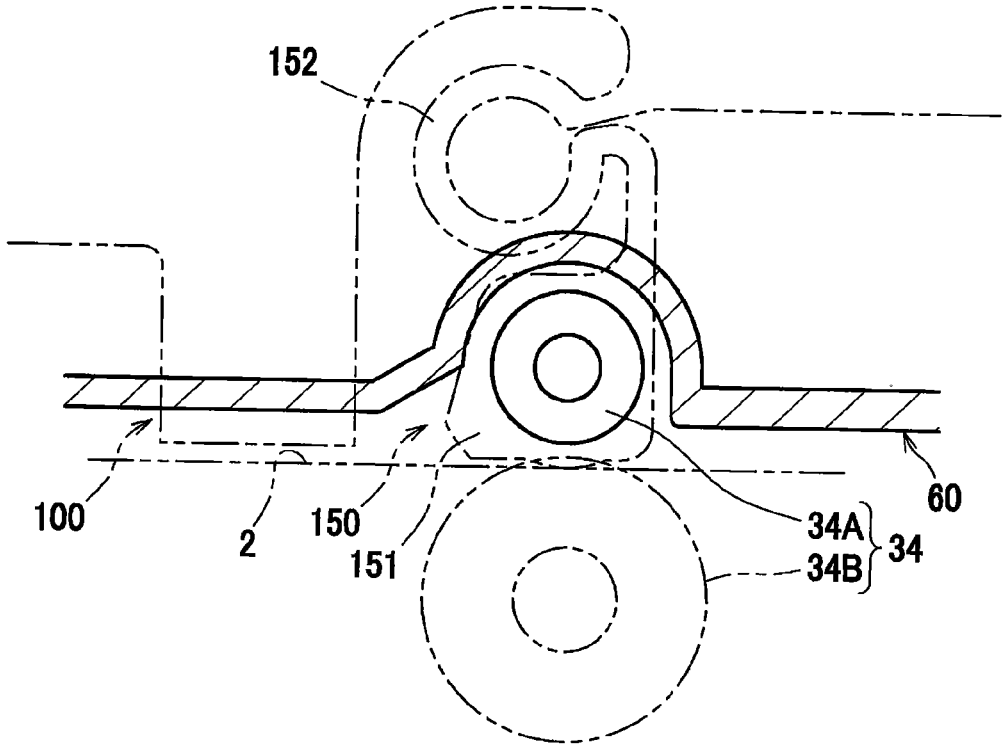
FIG. 13A is a view illustrating an uppermost position of a follow roller in the laser printer according to the embodiment.

As shown in FIG. 11, the second separating parts 150 maintain the follow roller 34A in a position separated from the drive roller 34B. Each second separating part 150 has a roller engaging part 151 in which the corresponding end of the follow roller 34A is inserted and engaged, and an elastic part 152 that connects the respective roller engaging part 151 to the corresponding left and right portion 110 or 120. The second separating parts 150 support the follow roller 34A so that the follow roller 34A can move vertically between a topmost position and a bottommost position. When the elastic parts 152 are deformed very little, the second separating parts 150 maintain the follow roller 34A in a center position between the topmost and bottommost positions. The center position (the position in FIG. 11) is an example of the third position. In the embodiment, the topmost position shown in FIG. 13A is the position of the follow roller 34A when the process cartridge 5 is mounted in the main casing 2 while the protection assembly 100 is in the attached state. At this time, the bottom edges of the roller engaging parts 151 contact parts of the main casing 2, enabling the second separating part 150 to maintain the follow roller 34A in a position separated from the drive roller 34B.

Figure 13B:
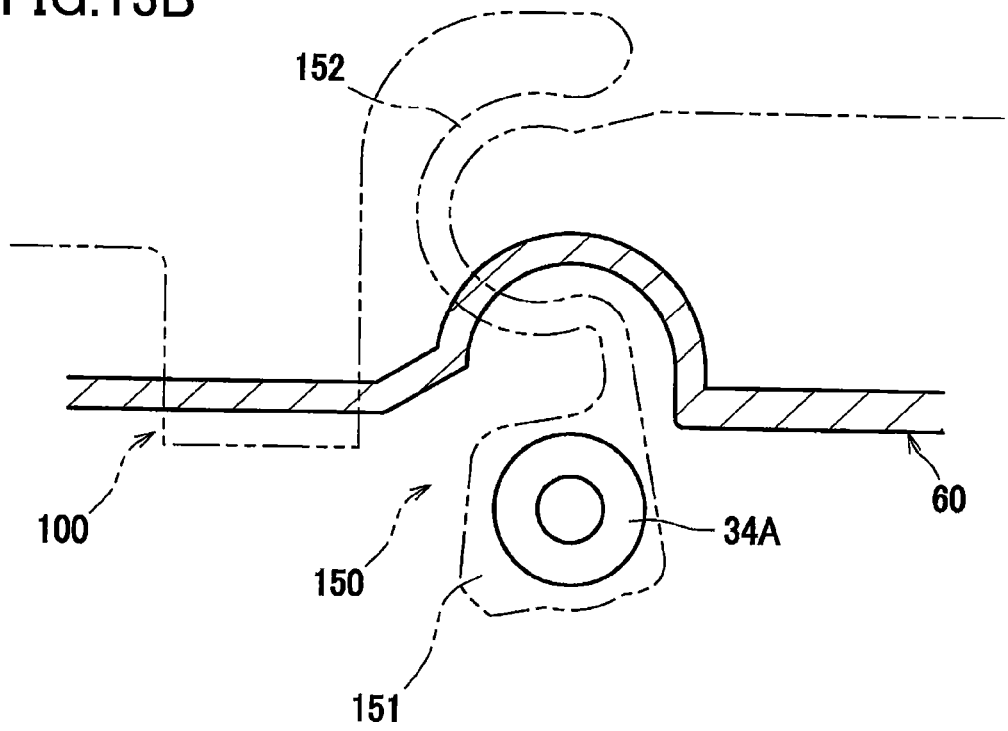
FIG. 13B is a view illustrating a lowermost position of the follow roller in the laser printer according to the embodiment.

As shown in the side view of FIG. 11, the elastic parts 152 extend first rearward from the corresponding left and right portions 110 and 120 above the corresponding roller engaging parts 151, curve to form a general C-shape, and then extend downward from the bottom end of the curved portion to connect to the corresponding roller engaging parts 151. As shown in FIG. 13A, the elastic parts 152 elastically deform when a force pushes the follow roller 34A upward, causing the opening in the C-shaped section of the elastic part 152 to close and the gaps between the elastic parts 152 and the left and right portions 110 and 120 as well as between the elastic parts 152 and the corresponding roller engaging parts 151 to decrease. As shown in FIG. 13B, the elastic parts 152 also elastically deform when a force pushes the follow roller 34A downward, causing primarily the opening in the C-shaped section to expand. Being provided with these elastic parts 152 that are capable of elastically deforming, the second separating parts 150 can hold the follow roller 34A such that the follow roller 34A can elastically move upward and downward (the moving directions of the follow roller 34A) from its center position shown in FIG. 11.

The boss engaging parts 160 are cylindrical parts that fit around and engage the corresponding bosses 60D formed on the process cartridge 5. The boss engaging parts 160 protrude outward from the corresponding left and right portions 110 and 120 in the corresponding left and right directions. When engaged with the bosses 60D, the boss engaging parts 160 are arranged between the bosses 60D and the boss contact parts 24C provided in the main casing 2.

The retaining parts 170 are parts that maintain the developing unit 7 in a state of contact with the positioning rollers 65. The retaining parts 170 are configured of the first-protrusion engaging part 104 and the second-protrusion engaging part 105 (see FIG. 7) and the left and right boss engaging parts 160. As shown in FIG. 12A, the first-protrusion engaging part 104 and the boss engaging part 160 of the left portion 110 are arranged such that, when viewed in the left-right direction, the shortest distance from the protruding part 77S to the boss 60D when the protection assembly 100 is in the attached state is approximately the same as the shortest distance when the developing unit 7 contacts the positioning rollers 65 and the protection assembly 100 is in the detached state. As shown in FIG. 12B, the second-protrusion engaging part 105 and the boss engaging part 160 of the right portion 120 are arranged such that, when viewed in the left-right direction, the shortest distance from the protruding part 70S to the boss 60D when the protection assembly 100 is in the attached state is approximately the same as the shortest distance when the developing unit 7 contacts the positioning rollers 65 when the protection assembly 100 is in the detached state. With this configuration, the developing unit 7 is brought into contact with the positioning rollers 65 when the protection assembly 100 is in the attached state, as shown in FIG. 8.

As shown in FIG. 5B, the covering part 180 constitutes part of the left portion 110, and is the portion that confronts and faces the coupling 76 from the outer (left) side when the protection assembly 100 is in the attached state. Thus, when the protection assembly 100 is attached, the covering part 180 is positioned between the coupling 76 and the drive input member 27 so as to cover the coupling 76 from the outer (left) side thereof.

As shown in FIG. 8, the sensor 25 provided in the main casing 2 in the embodiment detects the presence of the spacer 130 constituting the protection assembly 100 when the process cartridge 5 is mounted in the main casing 2. Specifically, when the process cartridge 5 is mounted in the main casing 2 with the protection assembly 100 attached, the actuator 25A of the sensor 25 is contacted by the center exposed part 132 of the spacer 130 and pivots from the non-detection position depicted by a chain line in FIG. 8 to the detection position depicted by a solid line.

By providing the sensor 25 to detect the presence of the spacer 130, the malfunction reporting unit 26 can notify the user of a malfunction just as when a sheet S becomes jammed in the laser printer 1, since the sensor 25 will detect the presence of the spacer 130 continuously. Note that the configuration of the embodiment cannot distinguish between a case in which a sheet S contacts the sensor 25 and a case in which the spacer 130 contacts the sensor 25. Thus, if the presence of the spacer 130 is detected continuously, the malfunction reporting unit 26 determines that a sheet S has become jammed and reports this as a paper jam error.

To attach the protection assembly 100 to the process cartridge 5, the left and right portions 110 and 120 are opened slightly outward in corresponding left and right directions from the state shown in FIG. 7 so that the gap between the left and right portions 110 and 120 is enlarged. In this state, the spacer body 131 of the spacer 130 is inserted through the opening 50A formed in the process cartridge 5 into the path 50, as depicted in FIG. 8.

In this way, the spacer body 131 of the spacer 130 is positioned between the first wall 51 and the second wall 52. At this time, the retaining parts 133 engage with the stepped parts formed on the second wall 52 and the retaining parts 134 engage with the rear edge of the third wall 53. Accordingly, these engagements suppress the spacer 130 from being easily pulled out from between the first wall 51 and the second wall 52.

Further, since the first wall 51 and the second wall 52 constitute walls that form the path 50 through which the sheet S passes in the embodiment, the spacer 130 can be attached to the process cartridge 5 by being inserted through the opening 50A that serves as the entrance to the path 50. Further, in a configuration such as that of the embodiment in which the drum unit 6 and the developing unit 7 are detachably assembled, the spacer 130 can be attached while the drum unit 6 and the developing unit 7 are assembled together by inserting the spacer 130 through the opening 50A.

Further, since the spacer body 131 of the spacer 130 is formed in a wedge shape that tapers toward the rear edge when viewed along the left-right direction, the spacer 130 can be easily inserted between the first wall 51 and the second wall 52.

Next, the left and right portions 110 and 120 are brought inward in the left-right direction. As shown in FIGS. 5 and 6, the drum engaging holes 101 are engaged with ends of the drum shaft 61A, the first-protrusion engaging part 104 with the protruding part 77S, the second-protrusion engaging part 105 with the protruding part 70S, the first separating parts 140 between the corresponding rotational shafts 71A and the rear parts of the engaging recesses 60C, the second separating parts 150 with the ends of the follow roller 34A, and the boss engaging parts 160 with the bosses 60D.

In this way, the protection assembly 100 is attached to the process cartridge 5. In the attached state, the developing roller 71 is separated from the photosensitive drum 61 and the follow roller 34A is held in its center position, as illustrated in FIG. 8. Further, the outer circumferences of the bosses 60D are covered by the boss engaging parts 160, and the developing unit 7 is in contact with the positioning rollers 65. The coupling 76 is also covered by the covering part 180 (see FIG. 5).

Once the protection assembly 100 is attached to the process cartridge 5, the process cartridge 5 is then mounted in the main casing 2. Since the second separating parts 150 maintain the follow roller 34A in the center position between the uppermost position shown in FIG. 13A and the lower most position shown in FIG. 13B, even if the follow roller 34A contacts a part in the main casing 2 and moves vertically when the process cartridge 5 is being mounted in the main casing 2, the follow roller 34A moves only up or down from the center position. Therefore, this configuration can reduce the amount of movement in the follow roller 34A compared to a structure in which the follow roller 34A can move from the uppermost position to the lowermost position, thereby reducing the amount of deformation in the protection assembly 100 in the vicinity of the second separating parts 150 that supports the follow roller 34A. Thus, this construction can reduce the load on the protection assembly 100.

A particular feature of the embodiment is that the load on the protection assembly 100 can be reduced since the second separating parts 150 can elastically hold the follow roller 34A so that the follow roller 34A is allowed to move. Reducing the load on the protection assembly 100 can increase the life of the protection assembly 100, making it possible to recover and reuse both the protection assembly 100 and the used process cartridge 5, for example.

When the process cartridge 5 is mounted in the main casing 2 with the protection assembly 100 attached, the boss engaging parts 160 are arranged between the corresponding bosses 60D and the boss contact parts 24C and the follow roller 34A is positioned apart from the drive roller 34B, as shown in FIG. 11. When the front cover 21 is subsequently closed, the drive input member 27 advances inward in order to engage with the coupling 76 but is prevented from doing so due to contact with the covering part 180, as illustrated in FIG. 5B. However, the compressed spring 27B suppresses a large force from begin applied to the covering part 180 or the drive input member 27 itself.

Subsequently, the laser printer 1 and the process cartridge 5 with the attached protection assembly 100 mounted in the laser printer 1 are packaged in a box or the like and shipped, i.e., transported to their destination. Since the spacer 130 is interposed between the first wall 51 and the second wall 52 in the embodiment, as shown in FIG. 8, the spacer 130 can suppress deformation in the first wall 51 when the process cartridge 5 incurs any impacts and the like during transport. Consequently, the protection assembly 100 can suppress toner leakage through the space between the developing roller 71 and the first wall 51, thereby suppressing toner leakage from the process cartridge 5 during transport.

Further, since the follow roller 34A is separated from the drive roller 34B, the protection assembly 100 can suppress deformation in the surfaces of the drive roller 34B and the follow roller 34A, which may occur when the drive roller 34B and the follow roller 34A are in constant contact during transport.

Since the developing unit 7 is in contact with the positioning rollers 65, the positioning rollers 65 can stabilize the position of the developing unit 7, which possesses the toner-accommodating section 74. Accordingly, this arrangement can suppress rattling of the developing unit 7 during transport, thereby better suppressing toner leakage from the process cartridge 5.

By using the positioning rollers 65 as members for fixing the position of the developing unit 7, the developing unit 7 and the drum unit 6 (positioning rollers 65) are less likely to wear than in a structure in which the developing unit contacts positioning parts that are fixed to the drum unit.

Since the circumferential walls of the boss engaging parts 160 are arranged between the corresponding bosses 60D and the boss contact parts 24C, as illustrated in FIG. 11, the process cartridge 5 can be restrained from rattling in the main casing 2 during transport. Further, by disposing the boss engaging parts 160 between the corresponding bosses 60D and the boss contact parts 24C, it is possible to reduce wear in the bosses 60D and boss contact parts 24C during transport.

If the user forgets to remove the protection assembly 100 prior to using the laser printer 1, the sensor 25 will detect the presence of the spacer 130 as illustrated in FIG. 8, and the malfunction reporting unit 26 will notify the user of the malfunction (paper jam). Consequently, the user can be reminded to remove the protection assembly 100.

By using the sensor 25 to detect sheets S as well as to detect the spacer 130, the number of required parts for the laser printer 1 in the embodiment can be reduced. From another perspective, the protection assembly 100 can be retroactively applied to the process cartridge 5 used in a laser printer 1 that was originally equipped with the sensor 25.

Since the drive input member 27 is blocked by the covering part 180 and not able to engage with the coupling 76 when the protection assembly 100 is attached to the process cartridge 5, the developing roller 71, the agitator 75, and the like cannot be driven to rotate, even if the user attempts to operate the laser printer 1 without first removing the protection assembly 100. Thus, this construction prevents the process cartridge 5 from being needlessly driven and, hence, suppresses needlessly added stress to the toner by agitation from the rotating agitator 75.

When notified of a malfunction (paper jam), the user removes the process cartridge 5 from the main casing 2 in order to remove the jammed sheet S. Since the exposed parts 132 are visible on the outside of the process cartridge 5, the user can easily notice at this time that the protection assembly 100 was not removed.

Since the protection assembly 100 integrally possesses the spacer 130, the first separating parts 140, the second separating parts 150, the covering part 180, and the like, all of the above parts can be removed at the same time by simply removing the protection assembly 100. This arrangement prevents the user from forgetting to remove one of the spacer 130, the first separating parts 140, and the like, unlike a structure in which these members are provided individually.

While the description has been made in detail with reference to specific embodiment thereof, it would be apparent to those skilled in the art that many modifications and variations may be made therein without departing from the spirit of the above-described embodiment, the scope of which is defined by the attached claims.

The structure of the spacer 130 described in the above-described embodiment is merely an example, and the present disclosure is not limited to this structure. For example, if the protection assembly possesses both left and right portions 110 and 120, as described in the above-described embodiment, the spacer may be configured without the exposed parts and retaining parts. Further, when viewed along the axial direction of the developing roller, the spacer need not have a wedge shape, provided that the spacer can be inserted between the first wall and the second wall.

The structures of the first separating parts 140 and the second separating parts 150 described in the above-described embodiment are also merely examples, and the present disclosure is not limited to these structures. For example, the first separating parts may be configured as spacers that are disposed between the photosensitive body and the developing roller in order to separate them from each other. The second separating parts may similarly be configured as spacers.

The covering part 180 in the above-described embodiment is configured to cover nearly the entire coupling 76 (drive input unit), but the present disclosure is not limited to this configuration. That is, the covering part may be configured to cover at least part of the drive input unit, provided that the covering part prevents the drive input unit from engaging with a drive input member in the device body.

The protection assembly 100 is formed as a single integrated member in the above-described embodiment, but the protection assembly of the present disclosure may be configured of a plurality of separate parts. For example, the spacer 130 shown in FIG. 7 may be configured as a separate member from the left and right portions 110 and 120. Further, when the protection assembly is configured of a plurality of parts, components for suppressing rattling, such as the boss engaging parts 160 described in the above-described embodiment, may be formed of parts (materials) having elasticity.

In the above-described embodiment, the follow roller 34A (second roller) and bosses 60D are provided with the drum unit 6, and the coupling 76 (drive input unit) is provided on the developing unit 7, but the present disclosure is not limited to this arrangement. For example, the drive input unit may be provided on the drum unit or may be provided on both the drum unit and the developing unit. The same can be said for the second roller and the bosses.

While the developing unit 7 is detachably mounted in the drum unit 6 in the above-described embodiment, the present disclosure is not limited to this configuration. For example, the developing unit may be configured to be non-detachable from the drum unit, but instead may be pivotably (displaceably) supported on the drum unit so that the developing roller can be separated from and brought into contact with the photosensitive body. Alternatively, the developing unit and drum unit may be integrally formed or otherwise configured to not move relative to each other.

While the sensing member of the above-described embodiment is configured using the sensor 25 for detecting the presence of sheets S, the present disclosure is not limited to this configuration. For example, the sensing member may be a dedicated sensor for detecting the presence of the spacer. By providing this dedicated sensor for detecting the presence of the spacer, the image forming apparatus can report that the protection assembly has not been removed as the malfunction when the sensor detects the presence of the space instead of reporting a paper jam.

In the above-described embodiment, the monochromatic laser printer 1 is exemplified as the image forming apparatus, but the present disclosure is not limited to this configuration. For example, a color printer is available as the image forming apparatus. Further, instead of the printer, a copying machine and a multi-function device provided with an original reading device such as a flat-bed scanner are also available.

In the above-described embodiment, the photosensitive drum 61 is exemplified as the photosensitive member, but the present disclosure is not limited to this configuration. For example, a photosensitive belt is also available instead of the photosensitive drum 61.

In the above-described embodiment, the sheet S, such as a plain paper, a postcard, and the like, is exemplified as the image recording sheet, but the present disclosure is not limited to this configuration. For example, an OHP sheet is also available instead of the sheet S.

What is claimed is:

1. An image forming apparatus comprising:

a housing;

a process cartridge detachably attached to the housing, the process cartridge comprising:

a drum unit including a photosensitive member; and a developing unit including a developing roller, an accommodating portion configured to accommodate developing agent, and a first wall, the developing roller defining a first axis extending in an axial direction and being configured to rotate about the first axis and supply the developing agent to the photosensitive member, the first wall having a first surface and a second surface opposite thereto, the first surface extending in the axial direction and facing the developing roller;

a protective member detachably attached to the process cartridge and including a spacer, the drum unit including a second wall having a third surface extending in the axial direction and facing the second surface, the spacer being disposed between the second surface and the third surface;

a sensing member configured to detect presence of the spacer when the process cartridge is attached to the housing;

a malfunction reporting unit configured to report malfunction when the sensing member detects the presence of the spacer; and a registration roller configured to convey an image recording sheet to the photosensitive member in a conveying direction, the sensing member being further configured to detect presence of the image recording sheet being conveyed between the registration roller and the photosensitive member.

2. The image forming apparatus according to claim 1, wherein the spacer has an exposed part protruding from between the first wall and the second wall so as to be visible from an outside of the process cartridge.

3. The image forming apparatus according to claim 1, wherein the protective member further includes a first separating part configured to maintain the developing roller in a position separated from the photosensitive member; and wherein the developing roller is configured to supply the developing agent to the photosensitive member when the developing roller contacts the photosensitive member.

4. The image forming apparatus according to claim 1, further comprising a first roller, wherein the process cartridge further comprises a second roller to convey an image recording sheet in cooperation with the first roller; and wherein the protective member further includes a second separating part configured to maintain the second roller in a position separated from the first roller.

5. The image forming apparatus according to claim 4, wherein the second roller is supported in the process cartridge and is configured to be moved between a first position and a second position; and wherein the second separating part is configured to maintain the second roller in a third position between the first position and the second position.

6. The image forming apparatus according to claim 5, wherein the second separating part is configured to hold the second roller such that the second roller is elastically movable from the third position to the first position and from the third position to the second position.

7. The image forming apparatus according to claim 1, wherein the protective member further includes a retaining part protruding from the spacer in a protruding direction; and wherein, when the protective member is attached to the process cartridge, the spacer is inserted between the first wall and the second wall in an insertion direction crossing the protruding direction and the retaining part engages the drum unit.

8. The image forming apparatus according to claim 7, wherein the spacer has a wedge shape that grows narrower toward a downstream side in the insertion direction when viewed in the axial direction.

9. The image forming apparatus according to claim 1, wherein the first wall and the second wall form walls of a path for guiding an image recording sheet from outside the process cartridge toward the photosensitive member; and wherein, when the protective member is attached to the process cartridge, the spacer is inserted between the first wall and the second wall along the path in an insertion direction.

10. The image forming apparatus according to claim 9, wherein the spacer has a wedge shape that grows narrower toward a downstream side in the insertion direction when viewed in the axial direction.

11. The image forming apparatus according to claim 1, wherein the process cartridge further comprises a boss protruding outward in the axial direction;

wherein the housing includes a boss contact part that contacts the boss when the process cartridge is attached to the housing;

wherein the protective member further includes a boss engaging part configured to engage the boss when the protective member is attached to the process cartridge; and wherein, when the process cartridge is attached to the housing and the protective member is attached to the process cartridge, the boss engaging part is arranged between the boss and the boss contact part.

12. The image forming apparatus according to claim 1, wherein the drum unit further includes a positioning roller defining a second axis in the axial direction and rotatably supported on the drum unit about the second axis; and wherein the developing unit is detachably attached to the drum unit, and when the developing unit is attached to the drum unit, the developing unit is positioned relative to the drum unit by contacting the positioning roller.

13. The image forming apparatus according to claim 12, wherein the protective member further includes a retaining part configured to maintain the developing unit in a state of contact with the positioning roller.

14. The image forming apparatus according to claim 1, wherein the housing further includes a drive input member configured to be moved between an advanced position and a retracted position in the axial direction, and configured to input a drive force into the process cartridge when the process cartridge is attached to the housing;

wherein the process cartridge further comprises a drive receiving unit configured to engage the drive input member to receive the drive force from the drive input member; and wherein the protective member further includes a covering part positioned between the drive input member and the drive receiving unit so as to cover the drive receiving unit when the protective member is attached to the process cartridge.

15. An image forming apparatus comprising:

a housing;

a process cartridge detachably attached to the housing, the process cartridge comprising:

a drum unit including a photosensitive member; and a developing unit including a developing roller, an accommodating portion configured to accommodate developing agent, and a first wall, the developing roller defining a first axis extending in an axial direction and being configured to rotate about the first axis and supply the developing agent to the photosensitive member, the first wall having a first surface and a second surface opposite thereto, the first surface extending in the axial direction and facing the developing roller; and a protective member detachably attached to the process cartridge and including a spacer, the drum unit including a second wall having a third surface extending in the axial direction and facing the second surface, the spacer being disposed between the second surface and the third surface, wherein the first wall and the second wall form walls of a path for guiding an image recording sheet from outside the process cartridge toward the photosensitive member, and wherein, when the protective member is attached to the process cartridge, the spacer is inserted between the first wall and the second wall along the path in an insertion direction.

16. An image forming apparatus comprising:

a housing;

a process cartridge detachably attached to the housing, the process cartridge comprising:

a drum unit including a photosensitive member; and a developing unit including a developing roller, an accommodating portion configured to accommodate developing agent, and a first wall, the developing roller defining a first axis extending in an axial direction and being configured to rotate about the first axis and supply the developing agent to the photosensitive member, the first wall having a first surface and a second surface opposite thereto, the first surface extending in the axial direction and facing the developing roller; and a protective member detachably attached to the process cartridge and including a spacer, the drum unit including a second wall having a third surface extending in the axial direction and facing the second surface, the spacer being disposed between the second surface and the third surface, wherein the housing further includes a drive input member configured to be moved between an advanced position and a retracted position in the axial direction, and configured to input a drive force into the process cartridge when the process cartridge is attached to the housing, wherein the process cartridge further comprises a drive receiving unit configured to engage the drive input member to receive the drive force from the drive input member, and wherein the protective member further includes a covering part positioned between the drive input member and the drive receiving unit so as to cover the drive receiving unit when the protective member is attached to the process cartridge.

* * * * *